US006776317B1

(12) United States Patent
Parker

(10) Patent No.: US 6,776,317 B1
(45) Date of Patent: Aug. 17, 2004

(54) TOOL LANYARD FOR HOLDING TOOLS

(75) Inventor: Michael J. Parker, Kemah, TX (US)

(73) Assignee: Parker Systems, Inc., Houston, TX (US)

( * ) Notice: Subject to any disclaimer, the term of this patent is extended or adjusted under 35 U.S.C. 154(b) by 0 days.

(21) Appl. No.: 09/971,259

(22) Filed: Oct. 4, 2001

Related U.S. Application Data

(60) Provisional application No. 60/277,054, filed on Mar. 19, 2001.

(51) Int. Cl.[7] ..... A45F 3/14

(52) U.S. Cl. ..... 224/251; 224/250; 224/254; 224/904

(58) Field of Search ..... 224/251, 254, 224/262, 904, 911, 259, 260, 621, 607, 610, 220, 219, 222, 250

(56) References Cited

U.S. PATENT DOCUMENTS

| | | | | | |
|---|---|---|---|---|---|
| 1,490,066 | A | | 4/1924 | Carr | |
| 3,772,740 | A | | 11/1973 | Seron | |
| 4,253,544 | A | * | 3/1981 | Dalmaso | 224/254 |
| D305,961 | S | | 2/1990 | Cobb | |
| 4,958,758 | A | | 9/1990 | Tipple et al. | |
| 5,052,602 | A | * | 10/1991 | Duchi et al. | 224/218 |
| 5,082,156 | A | | 1/1992 | Braun | |
| 5,083,522 | A | * | 1/1992 | Ashrow | 114/215 |
| D377,862 | S | | 2/1997 | Moore | |
| 6,036,066 | A | * | 3/2000 | Giacona, III | 224/148.6 |
| 6,065,658 | A | * | 5/2000 | Hashimoto | 224/254 |
| 6,131,780 | A | | 10/2000 | Becker | |
| 6,216,319 | B1 | | 4/2001 | Elkins | |
| 6,299,040 | B1 | * | 10/2001 | Matias | 224/254 |

* cited by examiner

*Primary Examiner*—Gregory Vidovich
*Assistant Examiner*—Maerena W. Brevard
(74) *Attorney, Agent, or Firm*—Conley Rose, P.C.

(57) ABSTRACT

A tool lanyard for releasable attachment to a safety harness of a workman to resiliently arrest the inadvertent dropping of a tool by the workman. The tool lanyard includes a looped cord on one end of the lanyard to receive a tool in a tightly gripped relation and a hook on an opposite end of the lanyard for mounting on a ring of the safety harness. A resilient connecting structure between the looped cord and the hook minimizes any shock action resulting from inadvertent dropping of the tool while arresting the dropping of the tool. The resilient connecting structure includes an outer non-elastic sheath about an inner elastic cord.

16 Claims, 2 Drawing Sheets

FIG. 1
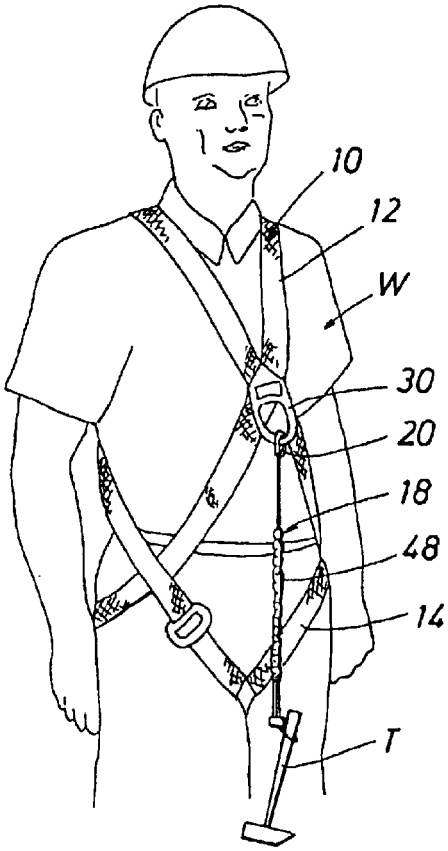
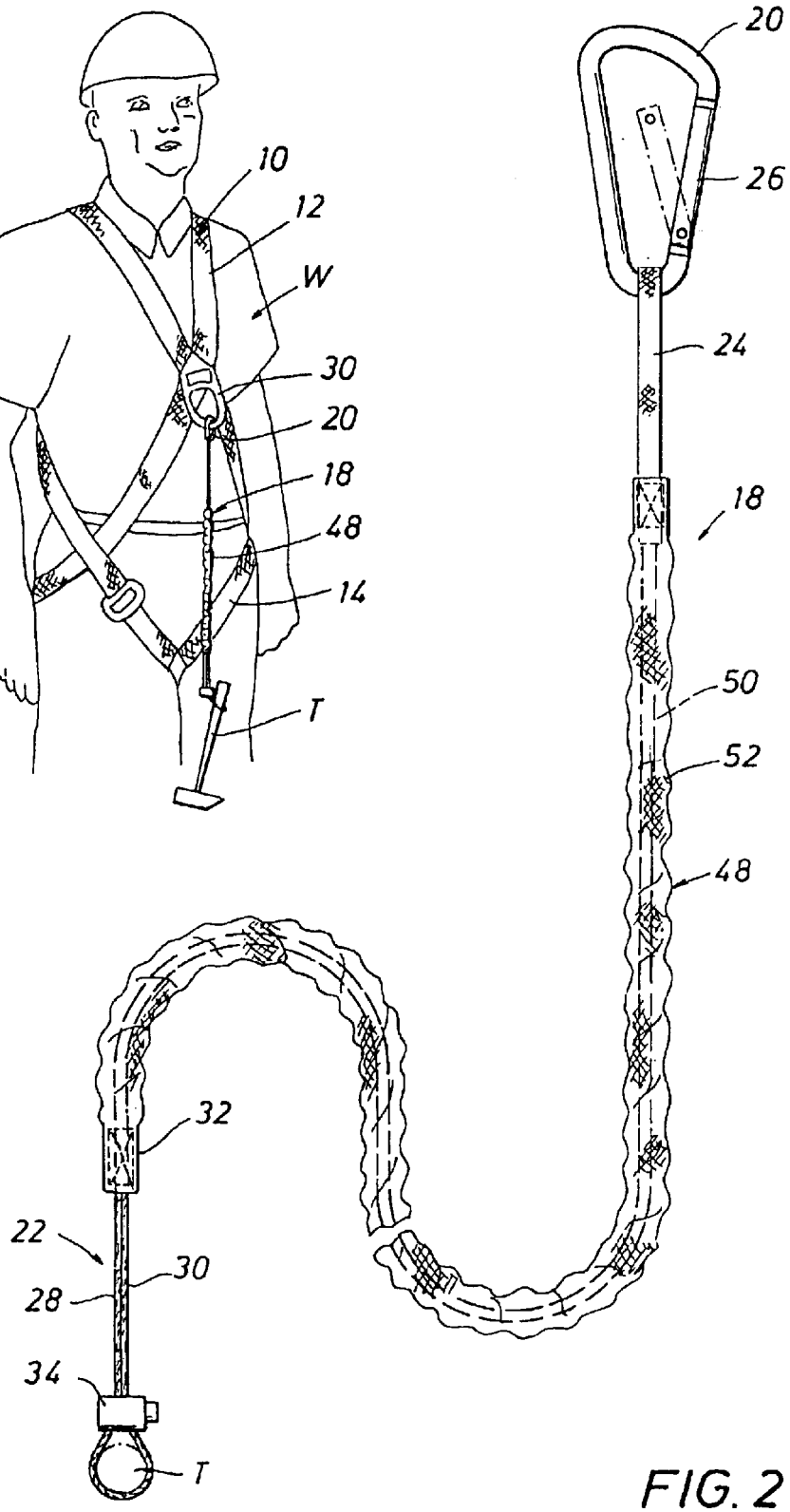
FIG. 2

TOOL LANYARD FOR HOLDING TOOLS

REFERENCE TO RELATED APPLICATIONS

This application claims the benefit of provisional application Serial No. 60/277,054 filed Mar. 19, 2001.

FIELD OF THE INVENTION

This invention relates to a tool lanyard for holding tools, and more particularly to a tool lanyard carried by a workman for securing and arresting the inadvertent dropping of tools, such as wrenches, drills, or hammers for example.

BACKGROUND OF THE INVENTION

Workmen in the construction of buildings or the like utilize various tools, such as wrenches, screwdrivers, hammers, drills, and other various tools. When the tool is manually carried by the workman and in use, the workman may inadvertently drop the tool. When such tools are not in use they are usually mounted on the body of the workman such as in belts about the body of the workman or in various pockets. Usually the tools are not tightly secured and may fall or be dropped by the workman particularly upon movement of the workman such as climbing, bending, or when in a prone position. Such movements may dislodge a tool which may result in a fall of the tool. It may be difficult to retrieve a tool after it is dropped.

Workmen are often times positioned at great heights particularly when working on multi-story buildings. Scaffolding is often utilized and a workman may have to climb on the exterior of the scaffolding. All of these activities may result in the dropping or fall of a tool by a workman and the tool may fall from a substantial height to present a safety hazard as a tool may strike a person at ground level. Retrieval of the tool is time consuming and may not always be possible.

It is desired that a tool holder carried by a workman be provided to secure a tool and arrest the inadvertent dropping of the tool by the workman.

SUMMARY OF THE INVENTION

The tool lanyard of the present invention for holding tools is normally secured at one end to a safety harness or other member on the body of a workman. A safety harness which is normally strapped about the shoulders, waist, and legs of a workman is normally connected to a fall arrestor. The tool lanyard may also be mounted on a waist belt or other suitable strap or belt.

The tool lanyard preferably has a snap hook on one end which is attached to a ring on the safety harness. A looped non-elastic cord tightly gripping the tool is connected to the other end of the lanyard and a stretchable elastic element or cord is connected between the non-elastic cord and the snap hook. The stretchable elastic cord fits within an outer flexible but non-elastic sheath which extends about the elastic cord and protects the cord from wear and tear, such as cuts or abrasions. The flexible sheath is preferably formed of a non-elastic webbing material. The outer non-elastic flexible sheath which receives the elastic cord is normally in a highly relaxed position and is kinked along its length when no load or weight is applied from the looped non-elastic cord extending about the tool. However, when a load is applied from a tool gripped by the looped cord, the elastic cord is stretched until the flexible sheath is extended to a taut relation. The stretching of the elastic cord increases substantially the length of the sheath. For example, the non-elastic flexible sheath may have a length of about 2 feet in a kinked relaxed condition and may be extended to about 3½ feet in length when taut to prevent any further stretching of the elastic cord. Thus, the non-elastic sheath and elastic cord provide a resilient mounting for a tool while arresting the downward movement of the tool. When the tool is not being used, it is normally supported by the harness for easy accessibility to the workman. In the event the tool is dropped or released while the lanyard is connected to the harness, the fall of the tool will be arrested by the resilient support with a minimum jerking or pulling action. Thus, a cushioning effect is provided to minimize any shock.

It is an object of the invention to provide a tool lanyard carried by a workman at one end and connected to a tool at an opposed end to stop the fall of a tool if inadvertently dropped by the workman.

An additional object of the invention is to provide such a tool lanyard connected at one end to a safety harness about the workman and resiliently mounting a tool thereon for resiliently arresting or stopping the fall of the tool.

Other objects, features, and advantages of the invention will be apparent from the following specification and drawings.

BRIEF DESCRIPTION OF THE DRAWINGS

FIG. 1 is a schematic showing of the tool lanyard of the present invention mounted at one end on the body safety harness of a workman and resiliently supporting a tool at an opposed end;

FIG. 2 is an elevational view of the tool lanyard shown in FIG. 1 removed from the safety harness;

DESCRIPTION OF THE INVENTION

Figure 3A:
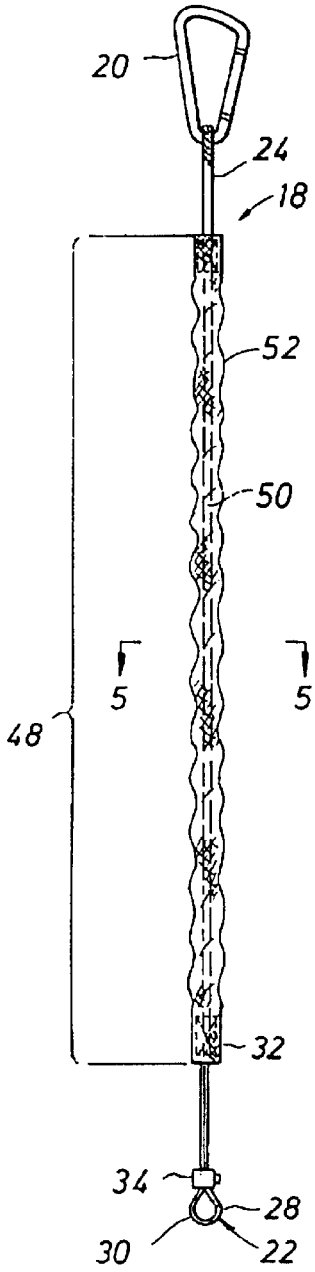
FIG. 3A is an elevational view of the tool lanyard shown in FIG. 2 and showing the intermediate stretchable portion of the lanyard in a relaxed portion.

Referring to the drawings and more particularly to FIG. 1, a body harness is shown generally at 10 about the body of a workman shown at W. Body harness 10 includes shoulder straps 12, and leg straps 14. The tool lanyard comprising the present invention is shown generally at 18 having on one end a hook or carabiner 20 and a looped cord 22 on an opposite end. Hook 20 is mounted on a non-elastic looped strap 24 having stitched ends to form the loop. Hook 20 is received within looped strap 24 and has a keeper 26 spring urged into a closed position. Keeper 26 may be forced to an open position for snapping of hook 20 on a suitable ring 30 of safety harness 10.

Lower loop 22 is formed by two parallel cords lengths 28 and 30 having ends stitched to a fabric end connecting strip 32. Loop 22 may be formed of an elastic or non-elastic cord and is adapted to receive a tool T such as a hammer, drill, wrench, or similar member which is manually utilized by a workman. Loose cord lengths 28, 30 are arranged to receive the tool and then cord lengths 28, 30 are tightened about the tool. For tightening cord lengths 28 and 30 about a tool such as a handle of a hammer after the handle is received in loop 22, a manually releasable gripping member is shown generally at 34 and is pushed tightly against the tool within loop 22. Gripping member 34 as shown in FIG. 4 includes an outer housing 36 with an elongate opening 38 therethrough. Cord lengths 28,30 are received within opening 38. A manually depressible plunger is shown at 40 received within housing 36 and having opening 42 also receiving cords lengths 28,30. A spring 43 continuously urges plunger 40 outwardly with the innermost peripheral surface defining opening 42 urged by spring 43 against cord lengths 28,30 to squeeze or grip cord lengths 28,30 tightly between the outermost peripheral surface defining opening 38 and the innermost peripheral surface defining opening 42 as shown in FIG. 3. The gripping force applied against cord lengths 28,30 is determined by the force exerted by spring 43. To slide or slip gripping member 34 along cord lengths 28,30 for gripping the tool T, plunger 40 is manually depressed to remove cord lengths 28,30 from a gripping relation and gripping member 34 is then manually moved along cord lengths 28,30 for tightly gripping of tool T by loop 22. Then, plunger 40 is manually released for retaining loop 22 about tool T by tightly gripping cord lengths 28,30. Tool T is thus firmly secured.

Mounted between the upper looped strap 24 and lower cord loop 22 is a stretchable connecting structure or section 48. Stretchable structure 48 includes an inner elastic member or cord 50 and an outer non-elastic fabric sheath 52 formed of a non-elastic tubular webbing material. Sheath 52 is secured between looped strap 24 and connecting strip 32 and protects inner cord 50 from wear and tear such as abrasions. Elastic cord 50 also has its ends secured to looped strap 24 and connecting strip 32. In the event a tool is inadvertently dropped, the fall of the tool is resiliently arrested. Dependent on the weight of the tool, sheath 52 may return a limited distance after being fully stretched by fall of the tool.

Figure 3B:
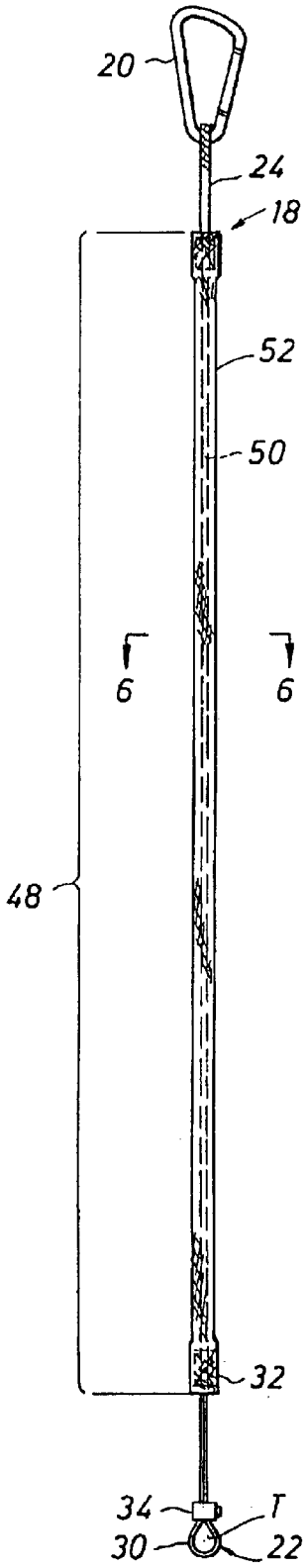
FIG. 3B is an elevational view of the tool lanyard shown in FIG. 3A in a taut position.
Figure 4:
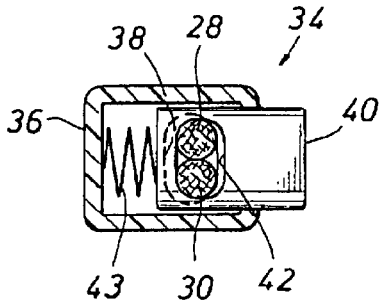
FIG. 4 is a sectional view of a manual release member for the looped cord about the taut to permit the looped cord to be drawn tightly about the tool.
Figure 5:
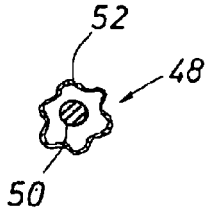
FIG. 5 is a section taken generally along line 5—5 of FIG. 3A and showing an elastic cord within an outer non-elastic sheath with the sheath being in a relaxed kinked condition.
Figure 6:
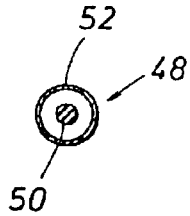
FIG. 6 is a section taken generally along line 6—6 of FIG. 3B and showing the non-elastic sheath in a taut relation.

In the relaxed condition of inner elastic member 50, outer flexible sheath 52 is kinked as illustrated in FIGS. 2 and 3A. The weight of a tool mounted in looped cord 22 upon being dropped would normally stretch elastic member 50 until flexible sheath 52 is taut as shown in FIGS. 2 and 3B. For example, flexible sheath 52 formed of a fabric webbing material may have a length of about 2 feet in a relaxed kinked condition as shown in FIG. 3A and may be stretched by a dropped tool to about 3½ feet before being taut as shown in FIG. 3A to resist any further stretching of elastic cord 50. Elastic cord 50 is designed to stretch at least about 6 inches. Stretchable section or structure 48 acts to permit a resilient support for a tool to reduce any shock action while limiting the downward movement of the tool.

While the tool lanyard has been shown as supported from the body harness of a workman, the lanyard could be supported from other members such as a belt or other member mounted on the body of the workman. Also, while a hook has been illustrated as releasably connecting an end of the lanyard to the body of a workman, other members such as a looped cord could be utilized for connecting the lanyard to the body of a workman. In addition, a hook connected to the looped cord could be connected to a tool for supporting the tool. The movement of the tool after dropping and being arrested may be between about 1 to 2 feet with the resistance against movement of the tool progressively increasing. The material of which the elastic cord or member may be of an elastic nylon material or of an elastic cotton fabric material, for example. The outer sheath may be formed, for example, of nylon, polypropylene, or cotton.

While the gripping member for drawing the cord length tight about the tool has been illustrated as having a manually releasable gripping member which may be pushed, the gripping member may be formed of various types of gripping devices which may utilize depressible or slidable members.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A tool lanyard for releasable connection to a workman to resiliently arrest the inadvertent dropping of a tool by the workman, said tool lanyard comprising:

a non-elastic tubular sheath having first and second sheath ends;

an elastic cord received within said non-elastic tubular sheath and having first and second cord ends, said first sheath end being secured to said first cord end and said second sheath end being secured to said second cord end to maintain said tubular sheath in a relaxed kinked condition when the lanyard is in an unloaded position;

a looped cord forming a loop at said first sheath end and having opposed ends secured to said first sheath end and said first cord end;

a manually releasable cord gripping member receiving said looped cord and moveable manually along said looped cord for gripping tightly a tool received within the looped cord;

a releasable anchor member for releasable connection to the torso of the workman to support the lanyard therefrom;

a looped strap forming a loop at said second sheath end and being directly secured to said second sheath end and said second cord end, said looped strap being releasably connected to said anchor member to connect and detach said anchor member from said non-elastic tubular sheath and said elastic cord;

said non-elastic tubular sheath being in a kinked relaxed position when the weight of the tool is not exerted against said non-elastic looped cord and being in a taut position to stop the stretching of said elastic cord and arrest the inadvertent dropping of the tool when the weight of the tool is exerted against said looped cord; and the tool lanyard having sufficient strength to withstand the forces applied to said tool lanyard upon the inadvertent dropping of the tool.

2. The tool lanyard as defined in claim 1, wherein said manually releasable cord gripping member comprises an outer housing receiving a spring urged manually depressible plunger, said outer housing and said plunger having alignable openings therein to receive a pair of cord lengths of said looped cord for gripping thereof between said outer housing and said plunger under the bias of said spring urged depressible plunger.

3. The tool lanyard as defined in claim 2, wherein said anchor member comprises a safety harness having shoulder straps and leg straps for releasable connection to the torso of the workman, and said releasable anchor member having a hook with a keeper receiving said non-elastic looped strap and arranged for connection to the safety harness.

4. The tool lanyard as defined in claim 1, wherein said anchor member includes a safety harness having shoulder straps and leg straps.

5. The tool lanyard as defined in claim 4, wherein said releasable anchor member includes a hook with a keeper for releasable attachment to said harness.

6. The tool lanyard as defined in claim 1, wherein said tubular sheath is formed from a webbing material of a nylon, polypropylene or cotton.

7. The tool lanyard of claim 1 wherein the looped strap is formed by folding the strap over and stitching its ends for sewing to said second sheath end and second cord end.

8. The tool lanyard of claim 1 wherein the first sheath end and first cord end are sewn to the looped cord and the second sheath end and second cord end are sewn to the looped strap.

9. A tool lanyard for releasable connection to a workman to resiliently arrest the inadvertent dropping of a tool by the workman, said tool lanyard comprising:

a non-elastic tubular sheath defining a main body for the lanyard and having first and second sheath ends at each end of the tubular sheath, the non-elastic tubular sheath forming a passage therethrough;

an elastic cord extending completely through said passage of said non-elastic tubular sheath and having first and second cord ends, said first sheath end being secured to said first cord end and said second sheath end being secured to said second cord end to maintain said tubular sheath in a relaxed kinked relation when the lanyard is in an unloaded position;

a looped cord of a generally circular cross section forming a loop at said first sheath end and having opposed ends secured to said first sheath end and said first cord end;

a cord gripping member receiving said looped cord and moveable manually along said looped cord for gripping tightly a tool received within the looped cord;

a releasable anchor member for releasable connection to the torso of the workman to support the lanyard therefrom;

a looped strap forming a loop at said second sheath end and being directly secured to said second sheath end and said second cord end, said looped strap being releasably connected to said anchor member to connect and detach said anchor member from said non-elastic tubular sheath and said elastic cord; and said non-elastic tubular sheath formed from a webbing material and being in a kinked relaxed position when the weight of the tool is not exerted against said non-elastic looped cord and being in a taut position to stop the stretching of said elastic cord and arrest the inadvertent dropping of the tool when the weight of the tool is exerted against said looped cord; and the tool lanyard having sufficient strength to withstand the forces applied to said tool lanyard upon the inadvertent dropping of the tool to prevent a parting of the tool lanyard.

10. The tool lanyard as defined in claim 9, wherein said manually releasable cord gripping member comprises an outer housing receiving a spring urged manually depressible plunger, said outer housing and said plunger having alignable openings therein to receive a pair of cord lengths of said looped cord for gripping thereof between said outer housing and said plunger under the bias of said spring urged depressible plunger.

11. The tool lanyard as defined in claim 9, further comprising:

the looped cord supports the tool; and the elastic cord is connected between the looped cord and the looped strap releasably attached to the anchor member.

12. A method of releasably connecting a tool to a workman with a tool lanyard to resiliently arrest the inadvertent dropping of the tool, the method comprising:

providing a non-elastic tubular sheath and having first and second sheath ends, the non-elastic tubular sheath forming a passage therethrough;

positioning an elastic cord completely through the passage of the non-elastic tubular sheath and having first and second cord ends, the first sheath end being secured to the first cord end and the second sheath end being secured to the second cord end for maintaining said tubular sheath in a relaxed kinked relation when the lanyard is in an unloaded position;

looping a looped cord at the first sheath end and securing opposed ends to the first sheath end and the first cord end;

providing a manually releasable cord gripping member receiving the looped cord and moveable manually along the looped cord for gripping tightly a tool received within the looped cord;

providing an anchor member for releasable connection to the torso of the workman to support the lanyard therefrom;

selectively connecting a looped strap forming a loop at the second strap end and being directly secured to the second strap end and second cord end, said looped strap being connected to the anchor member;

the non-elastic tubular sheath being in a kinked relaxed position when the weight of the tool is not exerted against said non-elastic looped cord and being in a taut position to stop the stretching of the elastic cord and arrest the inadvertent dropping of the tool when the weight of the tool is exerted against the looped cord; and withstanding the forces applied to the lanyard upon the inadvertent dropping of the tool to prevent the lanyard from separating.

13. The method as defined in claim 12, wherein said manually releasable cord gripping member comprises an outer housing receiving a spring urged manually depressible plunger, said outer housing and said plunger having alignable openings therein to receive a pair of cord lengths of said looped cord for gripping thereof between said outer housing and said plunger under the bias of said spring urged depressible plunger.

14. The method as defined in claim 12, wherein said anchor member includes a hook receiving said looped strap and arranged for connection to the safety harness having shoulder straps and leg straps.

15. The method as defined in claim 12, further comprising:

supporting the tool with a looped cord; and connecting the elastic cord between the looped cord and the looped strap releasably attached to the anchor member.

16. The method as defined in claim 12, wherein the tubular sheath is formed from a webbing material of a nylon, polypropylene or cotton.

* * * * *